US005259653A

United States Patent [19]

Jacobsen

[11] Patent Number: 5,259,653

[45] Date of Patent: Nov. 9, 1993

[54] CARRIER HANDLE FOR MOUNTING ON CARTON PACKINGS HAVING A FOLDED TOP CLOSURE

[76] Inventor: Peder Jacobsen, Skoletoften 16, Sevel,, DK-7830 Vinderup, Denmark

[21] Appl. No.: 768,404

[22] PCT Filed: Apr. 3, 1990

[86] PCT No.: PCT/DK90/00083

§ 371 Date: Oct. 7, 1991

§ 102(e) Date: Oct. 7, 1991

[87] PCT Pub. No.: WO90/11940

PCT Pub. Date: Oct. 18, 1990

[30] Foreign Application Priority Data

Apr. 7, 1989 [DK] Denmark ..... 1672/89
Nov. 22, 1989 [DK] Denmark ..... 5863/89

[51] Int. Cl.[5] ..... B65D 25/28

[52] U.S. Cl. ..... 294/33; 220/742; 294/27.1

[58] Field of Search ..... 294/27.1, 31.2, 32, 294/33, 137, 142, 148, 166; 16/114 R; 215/100 A; 220/694, 737, 741, 742, 94 R, 96; 222/465.1, 469, 475; 248/145.6; D7/38.7, 393, 394, 622; D9/369, 435, 443, 455

[56] References Cited

U.S. PATENT DOCUMENTS

D. 186,555 11/1959 Hunt ..... 294/32 X
D. 188,706 8/1960 Sircovics ..... 220/741 X
2,116,148 5/1938 Hawley ..... 294/27.1 X
2,757,034 7/1956 Puhl ..... 294/27.1
2,810,503 10/1957 Krueger ..... 294/27.1 X
2,871,051 1/1959 Nesslein et al. ..... 294/27.1
2,902,309 9/1959 House ..... 294/33
2,976,074 3/1961 Weiner et al. ..... 294/27.1 X
3,024,943 3/1962 Yeager ..... 220/742
3,056,622 10/1962 Hilderbrandt et al. ..... 294/31.2
3,153,507 10/1964 House ..... 294/33 X
3,250,562 5/1966 Frasure et al. ..... 294/31.2
4,889,376 12/1989 Nagy ..... 294/33

*Primary Examiner*—Johnny D. Cherry
*Attorney, Agent, or Firm*—Antonelli, Terry, Stout & Kraus

[57] ABSTRACT

A carrier handle unit mountable on a top folded carton packing, the unit comprising a handle portion (4) connected to a vertical base plate portion (2) having at its top end a rigid upper portion (6) for engaging the top folding of the packing and at its lower end forwardly projecting, resiliently outwardly bendable plate arm members (8), which at their outer ends, are shaped with short inwardly and towards each other projecting end portions (10) that are able to grip over the outside of the packing opposite packings side engaged by the base plate portion. The carrier handle unit can be made in one piece, it provides for a stable connection between the handle portion and the packing, and it is easy to mount and dismount by a crosswise displacement or pivoting because the plate arm members need be spread only slightly for movement thereof into or away from their engagement with the said outside of the packing.

5 Claims, 2 Drawing Sheets

CARRIER HANDLE FOR MOUNTING ON CARTON PACKINGS HAVING A FOLDED TOP CLOSURE

TECHNICAL FIELD

The present invention relates to a carrier handle unit for releasable mounting on carton packings having a folded top closure, typically milk and juice cartons.

BACKGROUND ART

It is a standing problem that these consumer packings can be difficult to handle, particularly for people with small or rheumatic hands, as the cartons are then a little too large.

On that background, carrier handle units have already been proposed which are more or less easy to mount, e.g. on milk cartons of the type made of a square carton sleeve having an upper roof edge folding, which is openable at one end and has an outwardly open cavity at the opposite end. This cavity is well suited to receive a carrier head on a carton surrounding portion mounted in a lower position around the carton itself, and when this or these portions are furthermore connected with a projecting handle member, the carton will thus be provided with a useful, easily seizable holder and pourer handle.

Such a handle unit is known e.g. from U.S. Pat. No. 2,992,847, where the carton surrounding portion is a four-sided plate ring adapted to be lowered over the upper end of the carton. At one of its sides, the plate ring is provided with an outwardly and downwardly projecting handle, which has at its top end a pivot pawl with a carrier head portion that can be swung into the said cavity and thus be brought into carrier engagement with the carton, while for demounting of the unit it can be swung outwardly from this engagement. It is unsuitable, however, that such a holder should consist of more parts, and in use the carrier head might incidentally be swung out of its engagement with the carton, whereby an annoying operational failure may occur. Furthermore, the positioning of a holder ring at the very top of the carton is not too good, since by pouring with the carton a rather powerful breaking influence on the carton will occur at that place.

In another known handle unit, cf. U.S. Pat. No. 2,976,074, the handle member is provided as a double wire loop, the upper end of which continues in a widened carrier head portion for introduction into the said cavity, while at the lower end the wire continues in a wire shaped surrounding portion around the carton. The wire is a spring wire that enables the carrier head portion to be brought into the cavity after the lowering of the surrounding portion over the carton, but since the connection between the surrounding portion and the carrier head portion is an outwardly bent handle portion of spring wire there will not be obtained any rigid or stiff engagement with the carton, which makes the handle unit uncomfortable in use. In a special embodiment the surrounding portion consists of two side wire hooks, which can be swung resiliently away from each other and thereby enable the surrounding portion to be mounted by a lateral insertion over the carton; the free ends of the wire hooks are joined after the mounting by hooking together respective bent out end portions of the free hook ends. By such a lateral insertion of the entire handle unit, it is easy to introduce the carrier head portion in the said cavity, but it is troublesome to have to carry out a wide resilient spreading of the wire hooks and a subsequent joining of their outer ends, and besides, such a joint will exhibit a certain tear risk.

Also juice cartons have been mentioned, whereby reference is made to cartons having that type of top closure which reveals itself as a flat carton top side with outwardly projecting, folded down triangular flaps at the opposed narrow sides. This carton type is also used extensively for wine. In this connection it is sufficient if the said carrier head portion is adapted so as to engage about the downfolded flap at the end of the top closure opposite to the opening end thereof, as a carrier engagement may then be established with the underside of the root area of the flap.

Also for such cartons, handle units have been developed, see WO 83/00852, which discloses a unit consisting of an upper carton surrounding ring having at one end a projection, in which a slot is provided for receiving the said triangular closure flap, while the projection continues downwardly in a handle portion having at its lower end an inwardly extending portion abutting the adjacent narrow side of the carton. The entire unit is separated in a joinable manner down through the handle portion, such that the separated parts are coherent with the respective opposed ends of the carton surrounding ring. For mounting this unit the surrounding ring, from a wide open position thereof, is closed around the carton until the two halfparts of the handle portion can be mutually joined. The slot forming part will hereby be introduced over or onto the triangular flap from opposite sides thereof, but this is a very troublesome manner of mounting the unit. It may well be achieved that the surrounding ring is tightened strongly about the carton by the wrapping on of the ring, but the mounting will be the more difficult the tighter the surrounding is, and in practice there is no need for any particularly tight squeezing of the carton.

With the use of the said surrounding rings there is connected a noticeable hygienic disadvantage, viz. in that they extend across the side of the carton located underneath the pouring opening of the carton. Fluid running down the carton side from this opening will, directly or through the capillary effect, intrude behind the ring portion covering that side, and such fluid will not be removed by wiping the carton side. Such an exterior fluid residue, e.g. of milk, may well give rise to bacteriological problems before the carton is emptied and removed from the normal area of use.

DISCLOSURE OF THE INVENTION

On this background, the invention more specifically relates to a handle unit for detachable mounting on carton packings having a folded top closure, typically milk and juice cartons, with a handle portion in connection with an upper carrier head portion, which is adopted to be brought into carrying engagement with a seizable portion of the top closure, e.g. an insert portion for insertion into an end cavity of the top closure or a slotted portion for receiving an outer downfolded end flap, and which is furthermore connected with holding means for establishing a holding engagement with the body of the carton packing. More particular, the invention has for its purpose to provide such a handle unit, which is noticeably improved relative to the prior proposals; according to the invention this is achieved by the carrier head portion being provided on a plate portion which extends downwardly along the carton side and forms,a holding base for a handle portion projecting from this plate portion, while the plate portion at or adjacent its lower end is connected with opposed, forwardly extending arm portions, which are resiliently bendable away from each other and at their outer ends are provided with end portions that are bent inwardly towards each other so as to be engageable over respective opposite edge areas of the carton side located opposed to the handle portion and at that place extend over a distance noticeably smaller than the half of the width of the narrow carton side.

Through the direct plate connection between the carrier head portion and the carton surrounding portion, independent of the presence of the handle portion, it is possible to achieve an advantageous rigid or semi-rigid connection between these portions, and it is hereby important that the width of the plate connection can be larger than the width of the handle portion, as the latter appears as a separate element projecting from the connector plate portion. In other words, the width of the connector plate portion will not be limited to a desirable small width of the handle portion, and just thereby it is possible to arrange for a suitably stiff connection. The handle portion may well contribute to this stiffness, but without being the only stiffening element.

The said protruding arm portions holding the carton at their outer ends will be located spaced noticeably from the top of the carton, whereby they will not give rise to any important breaking action on the carton when the carton is tilted for pouring purposes. For an efficient holding of the carton, it is sufficient that the outer arm ends be shortly protruding over the corners of the carton side opposite to the handle portion, this having two important effects:

1) The holding unit can be introduced laterally by a crosswise displacement or pivoting over the carton by a relatively small spreading of the arm portions, viz. a spreading only corresponding to the length of the bent in end portions, whereby the arm portions will in no way need to be super resilient, but resilient only to such a degree that they may well consist of die cast plastic produced integrally with the said plate portion. Thus, it will be quite easy to mount the unit by a lateral introduction, whereby the carrier head portion will also be easy to bring in carrier connection with the carton.

2) After the mounting of the unit, the outer bent-in end portions of the projecting arms will not meet each other at the opening side of the carton, i.e. the said surrounding portion will be interrupted at the middle area of this carton side. This involves that fluid running down this side from the pouring opening will not meet with or get deposited behind the surrounding portion, i.e. the liquid will be freely accessible for wiping without giving rise to noticeable hygienic problems.

Thus, the holder unit according to the invention may appear as a unitary casting, which in addition to being produced as a single piece in a simple manner can also exhibit important advantages both with respect to mounting and use.

In the following the invention is described in more tail with reference to the drawings.

BEST MODE FOR CARRYING OUT THE INVENTION

Figure 1:
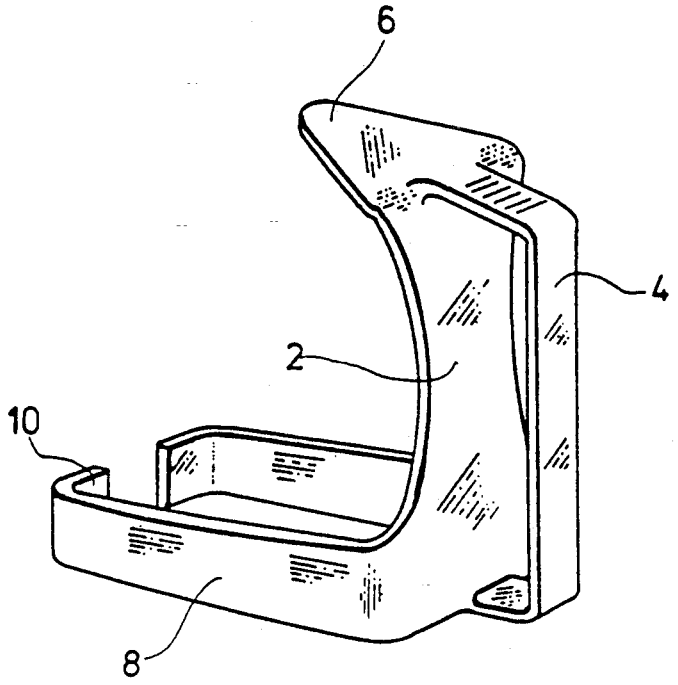
FIG. 1 is a perspective view of a first embodiment of a handle unit according to the invention, FIG. 2 the same, shown mounted on a milk carton.

The handle unit shown in FIG. 1 is a one-piece plastic casting comprising a base plate portion 2 which, at its top and bottom end, is connected with a projecting handle portion 4, while at its top it continues in an upwardly tapered plate portion 6 that projects upwardly while slanting to the opposite side of the handle 4. At the side edges of its lower end the base plate 2 continues in a pair of opposite plate arms 8 which in a parallel or slightly converging manner project to the opposite side of the handle 4. At their outer ends the plate arms have an inwardly bent end portion 10, such that these end portions are located just opposite to each other.

Figure 2:
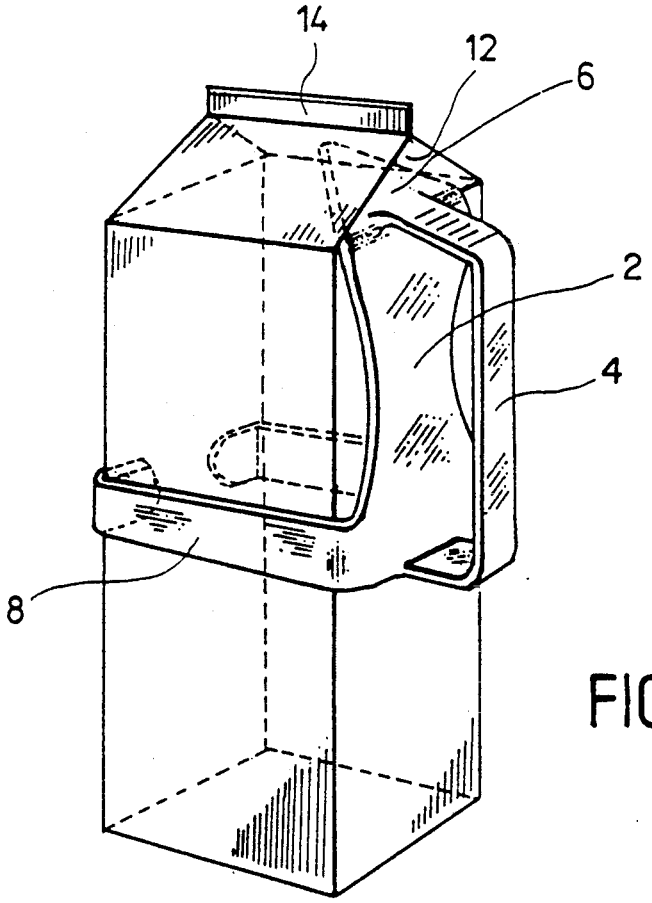

The plate arms 8 are resiliently outwardly bendable, and since the end portions 10 are each of a relatively short length, the arms will be easy to bend out into positions, in which they can be introduced laterally over a milk carton, see FIG. 2, by a crosswise displacement or pivoting. By such a lateral mounting movement of the handle unit, the plate portion 6 serving as a carrier head portion is easy to introduce into the upper, laterally exposed cavity 12 in the top closure 14 of the milk carton, and the mounting of the handle unit will be completed when at the end of the mounting movement, by a crosswise displacement or pivoting the plate arms 8 swing resiliently together against the carton and with the end portions 10 engaging over the carton side opposite to the handle 4. The unit can be correspondingly easily released, as it is sufficient to spread the plate arms 8 slightly, e.g. by pressing the end portions 10 away from each other, outwardly from their holding engagement with the carton side.

Thus, the handle unit is easy to release and dismount in an intentional manner, while it can hardly be released in an unintentional manner, i.e. in use it will remain mounted with a high stability. During pouring of or with the carton it is advantageous that the carton is carried by the arm end portions 10 way down on the carton, though not as far down as the middle of the carton, as the carton could then incidentally tilt out of its engagement with the carrier head, even though the handle unit would still be stabilized adjacent the carton surrounding area. The handle unit, therefore, should be adapted to standard milk cartons such that these will be held about the upper half of the carton.

As mentioned it is advantageous that there is a free space between the opposed end portions 10, as small fluid portions running down the respective carton side from the pouring opening of the carton will not then be held back by the carton surrounding portion or get deposited therebehind. Also, the rundown area on the carton side can be freely wiped off.

Figure 3:
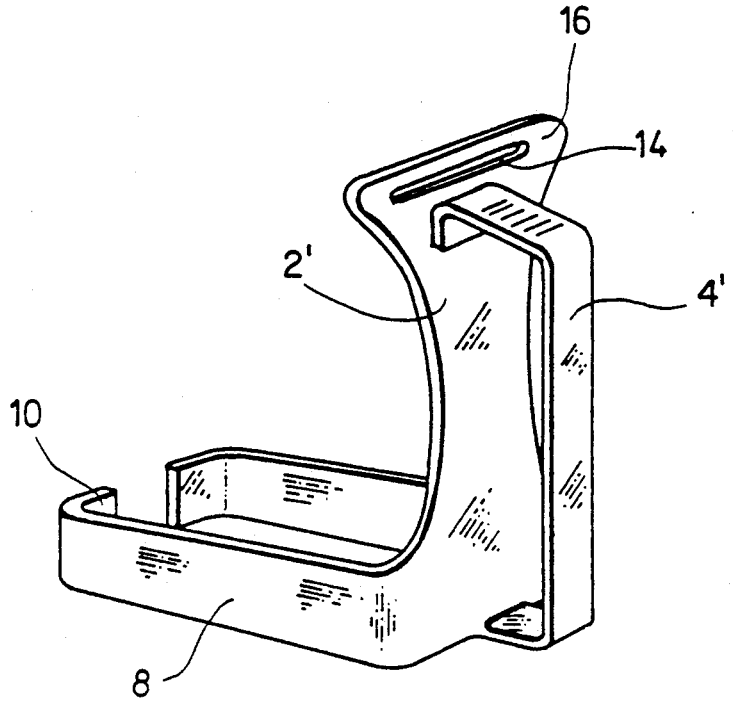
FIG. 3 is a view corresponding to FIG. 1 of another embodiment of the handle unit, and FIG. 4 the same, shown mounted on a juice carton.
Figure 4:
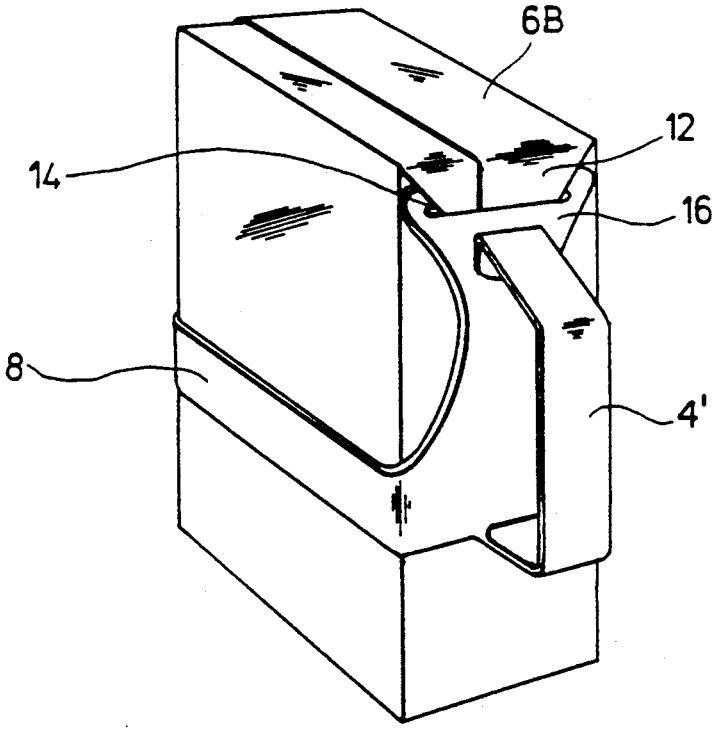

The handle unit according to FIG. 3 is adapted for cartons of the type having a flat top closure with protruding, downfolded triangular flaps 12, see FIG. 4. Here the carrier head portion 6 of FIG. 1 is substituted by a horizontal slot 14 in the upper end portion 16 of the base plate 2'. By considering FIG. 4 it will be easily understood that the handle unit is mountable after a slight bending out of the triangular flap 12 and a following insertion of the flap into the slot 14 while the handle unit is held in an inclined position swung out from the carton side about this area of engagement. The handle unit may then be swung into its mounted position by a spreading and introduction of the plate arms 8.

The carrier engagement at the triangular flap 12 can be established either by the top edge of the upper end portion 16 abutting the underside of the root portion of the flap or by the side edges of the flap abutting the opposed ends of the slot 14. By the very swinging home of the unit for the mounting thereof, the flap 12 will be influenced to be slightly bent immediately at the slot area, and after the mounting of the unit this deformation will contribute to the holding of the unit in its upper position on the carton. In this connection it will be fully in order that the plate arms 8 engage the carton down below the middle thereof, because when the carton is poured it cannot leave its holding engagement at the flap 12 anyway. Also this handle unit will be well secured against being unintentionally released, while it is otherwise easy to release.

It will be appreciated that due to the relatively broad base plate 2, a stable connection is obtained between the different portions of the unit, such that the handle 4 itself can be designed so as to be suitable only as a handle.

I claim:

1. A handle unit for detachable mounting on carton packings having a folded top closure such as milk and juice cartons, said handle unit having upper and lower ends and being formed integrally as one piece and comprising a handle portion in connection with a rigid upper, plate-like carrier head portion at said upper end, which carrier head-portion is angled upwardly so that the carrier head portion can be inserted into an end cavity of the top closure of a carton packing for snugly engaging said top closure with the lower end of the handle unit in a position pivoted out from the carton side adjacent the end cavity of the top closure and so that the handle unit can be brought into carrying engagement with a seizable portion of the top closure by pivoting the lower end of the handle unit into a final mounted position on the carton, and which handle portion is furthermore connected with holding means of the handle unit for establishing a holding engagement with the body of the carton packing, wherein a. the handle portion projects from a vertical base plate portion of the handle unit adapted to be placed flat against the carton side, said upper carrier head portion being located at an upper end of said vertical base plate portion, b. said carton packing holding means being associated with the vertical base plate portion solely at the lower end thereof, c. said holding means being constituted by opposed flat arm members projecting forwardly from the lower end of the base plate portion to respective outer arm end portions bent towards each other for engaging the carton side opposite that carton side engaged by the vertical base plate portion when the handle unit is in its mounted position, d. said flat arm members being resiliently bendable away from each other for allowing insertion of the arm members laterally over the carton body and snap locking of said outer arm end portions at said opposite carton side when said handle unit is pivoted to the final mounting position, e. said outer arm end portion each having a length smaller than half the distance between the opposed flat arm members, and f. said handle unit being downwardly completely open so as to be mountable on said carton with its lower end spaced above the bottom of said carton.

2. A handle unit according to claim 1, wherein the handle portion is constituted by a relatively narrow portion, which, at both its upper end and its lower end, is connected with the base plate portion, which is broader than the handle portion.

3. A handle unit according to claim 1, said arm members are constituted by plate shaped arm.

4. A handle unit according to claim 1, wherein said integrally formed one piece handle unit is a diecast plastic member.

5. A handle unit according to claim 1, wherein said upper carrier head portion is an upper, obliquely bent out part of the base plate portion.

* * * * *